US005784090A

United States Patent [19]

Selensky et al.

[11] Patent Number: 5,784,090

[45] Date of Patent: Jul. 21, 1998

[54] USE OF DENSITOMETER FOR ADAPTIVE CONTROL OF PRINTER HEATER OUTPUT TO OPTIMIZE DRYING TIME FOR DIFFERENT PRINT MEDIA

[75] Inventors: Ronald J. Selensky, Poway; Brent W. Richtsmeier, San Diego, both of Calif.

[73] Assignee: Hewlett-Packard Company, Palo Alto, Calif.

[21] Appl. No.: 549,900

[22] Filed: Oct. 30, 1995

Related U.S. Application Data

[63] Continuation-in-part of Ser. No. 511,321, Aug. 4, 1995, Ser. No. 56,287, Apr. 30, 1993, Pat. No. 5,479,199, Ser. No. 137,388, Oct. 14, 1993, Pat. No. 5,467,119, and Ser. No. 238,091, May 3, 1994.

[51] Int. Cl.[6] ..... B41J 2/01

[52] U.S. Cl. ..... 347/102; 347/16

[58] Field of Search ..... 347/102, 5, 16; 358/502; 364/930.41

[56] References Cited

U.S. PATENT DOCUMENTS

| | | | |
|---|---|---|---|
| 4,127,870 | 11/1978 | Colditz | 358/77 |
| 4,469,026 | 9/1984 | Irwin | 101/426 |
| 5,212,498 | 5/1993 | Sugimori | 346/25 |
| 5,428,384 | 6/1995 | Richtsmeier et al. | 347/102 |
| 5,502,475 | 3/1996 | Kaburagi et al. | 347/102 |
| 5,541,625 | 7/1996 | Holstun et al. | 347/5 |
| 5,608,439 | 3/1997 | Arbeiter et al. | 347/102 |

FOREIGN PATENT DOCUMENTS

| | | | |
|---|---|---|---|
| 423820 | 4/1991 | European Pat. Off. | 347/102 |
| 4118645 | 1/1992 | Germany | 347/102 |
| 1-113249 | 5/1989 | Japan . | |
| 3-151239 | 6/1991 | Japan . | |

*Primary Examiner*—Benjamin R. Fuller
*Assistant Examiner*—Christina Annick
*Attorney, Agent, or Firm*—Dennis G. Stenstrom

[57] ABSTRACT

An inkjet printer whereby high density graphics images can be printed without smearing and without either a reduction of print speed or a degradation of print quality is disclosed. Previous methods of inducing drying on inkjet output in printers with heaters did not use print density to adjust heater output. Heater output was simply adjusted based on the type of media so destruction of the media did not take place. The media was given enough time to dry by either lowering the print speed of the printer or utilizing special multi-pass print modes. As a result, the throughput of the printer was reduced. The disclosed inkjet printer allows for greater heater drying to be applied to output printed with greater densities of ink. The inkjet printer comprises a carriage mounted inkjet printing mechanism for applying liquid ink to a print medium as successive columns of dots contained within horizontal swaths to thereby form a portion of the image of an image to be printed on a sheet of print media. The printer and method comprises the steps determining a maximum density of dots in a first horizontal swath, applying a variable quantity of heat to the media based upon the maximum density of said dots and the nature of the print media, and moving a plurality of inkjet nozzles across the print medium and applying a specified amount of liquid ink from specified inkjet nozzles onto the print medium as successive columns of dots contained within a first swath of the image. The maximum print density can be calculated by counting drops of ink in each of several overlapping grids. Thus, the inkjet printer utilizes information about the print density to control the heater output level rather than controlling the print speed of the inkjet printer, or using multi-pass print modes which reduce printer throughput. Similarly, this invention can be applied to print devices that control air flow or fan speed or any other device that provides direct drying of printed media based on the analysis of the ink density of the printing being performed.

5 Claims, 9 Drawing Sheets

USE OF DENSITOMETER FOR ADAPTIVE CONTROL OF PRINTER HEATER OUTPUT TO OPTIMIZE DRYING TIME FOR DIFFERENT PRINT MEDIA

CROSS-REFERENCE TO RELATED APPLICATIONS

The present invention is a continuation-in-part of copending and commonly assigned applications: DENSITOMETER FOR ADAPTIVE CONTROL OF INK DRYING TIME FOR INKJET PRINTER, by Arbeiter, et al., Ser. No. 08/511,321, filed Aug. 4, 1995; PRINT ZONE RADIANT HEATER FOR INKJET PRINTER, Moore, et al., Ser. No. 08/056,287 filed Apr. 30, 1993, now U.S. Pat. No. 5,479,199; THERMAL INKJET PRINTER WITH PRINT HEATER HAVING VARIABLE HEAT ENERGY FOR DIFFERENT MEDIA, by Richtsmeier, et al., Ser. No. 08/137,388, filed Oct. 14, 1993, now U.S. Pat. No. 5,467,119; and METHOD OF MULTIPLE ZONE HEATING OF INKJET MEDIA USING SCREEN PLATEN, by Broder, et al., Ser. No. 08/238,091, filed May 3, 1994; and is related to the following copending and commonly assigned U.S. patent applications ADAPTIVE CONTROL OF SECOND PAGE PRINTING TO REDUCE SMEAR IN AN INKJET PRINTER, by Jason Arbeiter, et al., Ser. No. 08/056,338, filed Apr. 30, 1993; IMPROVED MEDIA CONTROL AT INK-JET PRINT ZONE, by Robert R. Giles, et al., Ser. No. 08/056,229, filed Apr. 30, 1993. The foregoing applications are herein incorporated by reference.

FIELD OF THE INVENTION

This invention relates generally to the field of thermal inkjet printers and more particularly to printing high quality images having densely inked areas without smearing the print media.

BACKGROUND OF THE INVENTION

Inkjet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet printers print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed nozzles attached to a printhead substrate that incorporates an array of firing chambers which receive liquid ink from the ink reservoir. Each chamber has a thin-film resistor, known as a inkjet firing chamber resistor, located opposite the nozzle so ink can collect between it and the nozzle. The firing of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

Color inkjet printers commonly employ a plurality of print cartridges, usually either two or four, mounted in the printer carriage to produce a full spectrum of colors. In a printer with four cartridges, each print cartridge contains a different color ink, with the commonly used base colors being cyan, magenta, yellow, and black. In a printer with two cartridges, one cartridge usually contains black ink with the other cartridge being a tri-compartment cartridge containing the base color cyan, magenta and yellow inks. The base colors are produced on the media by depositing a drop of the required color onto a dot location, while secondary or shaded colors are formed by depositing multiple drops of different base color inks onto the same dot location, with the overprinting of two or more base colors producing the secondary colors according to well established optical principles.

When a number of pixels in a particular area of an absorbent print medium such as bond paper absorb the liquid solvent constituent (typically water) of the ink, the paper fibers in that area will expand until the solvent has evaporated or otherwise dispersed. Because the dampened area of the print medium is typically constrained in the plane of the paper by adjacent less damp areas and/or by the paper advance mechanism and from below by a platen, the dampened area has a tendency to buckle upwards towards the nozzle (a problem referred to as "cockle"). If the height of the buckle exceeds the nominal spacing between the pen and the paper, then the ink in that area will be scraped by the pen as the pen retraces over some or all of the buckled area during a subsequent sweep over the same in the opposite direction (bidirectional and certain color printing modes) or prior to printing a sweep over an overlapping area (multiple pass printing modes). Such scraping causes smearing of the still damp ink and a degradation of image quality.

A related problem is "curling" of the paper. As a result of the differential absorption of solvent on the two sides of the paper, once the paper exits from the feed mechanism, it is no longer under tension and has a tendency to curl. Depending upon the extent of the curl, which is a function of both overall image density and throughput speed, the printed surface will be urged against various stationary parts of the printer between the carriage and the output tray, and at least the densest parts of the image will be smeared.

The print medium becomes damper and remains damp for a longer time as more ink is applied on the same area of the print medium. Thus, the probability of cockle or curling increases when ink density of a print image increases to produce intense black or colored portions of the image. The probability of smearing also increases when the speed of the printer increases and less time is allowed for the ink to dry, or when the distance between the paper and the nozzle is reduced to more accurately define the size and location of the individual dots of ink. Problems associated with scraping of the nozzles against the raised portions of the image are most noticeable during high quality multiple pass printing modes in which the nozzle passes several times over the same area. The curling problem is particularly noticeable in high quality, high throughput (single pass) printing modes in which a large quantity of ink is deposited over a relatively large area in a relatively short time.

One known solution of the scraping problem is to increase the spacing between the pen and the print medium. However, because such an increase in spacing would reduce the precision and sharpness of the ink drops and thus degrade the print quality, that solution is not satisfactory for printing high quality text and graphics. These problems may also be avoided by providing a relatively long fixed time delay between successive sweeps by the pen. However, such a solution decreases the throughput of the printer. Another alternative is to provide special print modes which make multiple sweeps across the media with a reduced amount of ink deposited on sweep. However, such a solution also decreases the throughput of the printer. At a time when the industry is in a pursuit to increase the throughput of printers so that they can keep up with the increasing throughput of central processing units, such a solution is unsatisfactory.

Another significant problem can occur when multi-color images are printed using thermal inkjet technology as described above. Specifically, this problem involves a situation known as "color bleed". In general and for the purposes set forth herein, color bleed is a term used to describe the diffusion/mixture of at least two different colored ink regions into each other. Such diffusion/mixture normally occurs when the different colored regions are printed next to and in contact with each other (e.g. at their marginal edges). For example, if a region consisting of a first coloring agent (e.g. black) is printed directly adjacent to and against another region consisting of a second coloring agent (e.g. yellow), the first coloring agent will often diffuse or "bleed" into the second coloring agent, with the second coloring agent possibly bleeding into the first coloring agent and results in the production of jagged, nonlinear lines of demarcation between adjacent colored regions instead of sharp borders there between.

In addition, color bleed problems in multi-ink systems are also caused by strong capillary forces generated in many commonly-used paper substrates. These capillary forces cause a "wicking" effect in which coloring agents are drawn into each other by capillary action through the fibers of the paper materials. This situation also results in a final printed image of poor quality and definition.

Prior solutions to bleed have largely involved the use of accelerated drying, the use of a separate fixer solution to pre-coat the paper, or the use of special paper. A known solution of the bleed problem is to accelerate the evaporating of the solvent by heating the print medium as it is being printed and/or circulating dry air over the freshly printed image; however excessive heating interferes with the proper adherence between the ink and the print medium, and may also cause the less densely inked areas to shrink and/or to become brittle and discolored. Fixing solutions add cost and additional liquid to be dispensed. Special paper limits the user to a small, select group of papers that are more expensive than plain paper.

Bleed control has also been accomplished in different ways by the printer's "print mode" techniques, whereby adjacent dots are placed on successive sweeps by the pen in specified patterns and with fixed time delays between printing adjacent dots. However, such solutions decrease the throughput of the printer. At a time when the printer industry is in a pursuit to increase the throughput of printers, such a solution is unsatisfactory.

As stated above a known solution to the problems of cockle, curl, scraping and bleed, is to accelerate the evaporating of the solvent by heating the print medium as it is being printed and/or circulating dry air over the freshly printed image. Previous attempts consisted of optimization of the heater at its greatest output that would not induce warpage in PET based special transparency media using minimal print densities under high temperature low humidity printing conditions, or cause charring of paper media positioned over the heater at high temperature low humidity conditions. While media warpage and charring were minimized, drytime and bleed problems still existed especially when high density plots were printed under moist conditions. Lack of rapid drying forced special print modes and sometimes induced delays to be implemented to be certain printed media was dry prior to handling resulted in loss of throughput. Also, printers are designed with special output trays that hold a printed sheet above the output tray for the full length of time that the following sheet is being printed before dropping the sheet on the previously printed sheets in the output stack. This solution adds complexity and cost to the printer mechanism and thus added cost to the consumer.

Approaches to eliminate cockle on inkjet printed paper have included attempts to modify existing papers by working with the paper suppliers. But inkjet printer customers often use plain papers which cockle at high print densities, because the heater was not driven at high enough power levels to dry the printed image quickly. Higher levels could not be used because the heater was adjusted to give maximum drying at high print densities and moist conditions without charring the paper when low density printing was done at dry conditions.

Thus, the prior art has failed to provide a satisfactory solution for printing high quality, high ink density graphic images at high throughput rates.

Accordingly, it would be advantageous to a solution to: special media warpage due to excessive heating rates when printing low density output, excessive dry times for printing high density output, excessive cockle on high print density plots using plain and special paper, excessive bleed on transparencies printed at high humidity conditions and sleeved, reduced throughput because of deliberate delays added to allow drying to occur between swaths, and reduced throughput due to the use of special print modes for paper and special media due to excessive dry times and low heater output.

SUMMARY OF THE INVENTION

An overall objective of the present invention is to provide an improved inkjet printer whereby high density graphics images can be printed without smearing and without either a reduction of print speed or a degradation of print quality. Previous methods of inducing drying on inkjet output in printers with heaters did not use print density to adjust heater output. Heater output was simply adjusted based on the print media so destruction of the media did not take place. The media was given enough time to dry by either lowering the print speed of the printer or utilizing special multi-pass print modes. As a result, the throughput of the printer was reduced. This invention allows for greater heater drying to be applied to output printed with greater densities of ink. Thus, drytime, bleed and cockle are reduced. Conversely, on plots printed with lesser amounts of ink, heater output is reduced yielding output with reduced curl and thermal deformation of the media. The invention also allows thermal absorption profiles of different media to be stored in firmware and accessed by the print driver. The correlation of the thermal absorption profiles and print density allow control of the heater for very specific and optimized drying for a given media and print file. In the case of families of similar media, relatively simple printer instructions would yield precise heater control for optimized drying across a family of media for the entire range of print densities. Thus, printing speed and print modes are not be governed by drying rates.

An inkjet printer according to the present invention comprises a carriage mounted inkjet printing mechanism for applying liquid ink to a print medium as successive columns of dots contained within horizontal swaths to thereby form a portion of the image of an image to be printed on a sheet of print media. The printer and method comprises the steps determining a maximum density of dots in a first horizontal swath, applying a variable quantity of heat to the media based upon the maximum density of said dots and the nature of the print media, and moving a plurality of inkjet nozzles across the print medium and applying a specified amount of liquid ink from specified inkjet nozzles onto the print medium as successive columns of dots contained within a first swath of the image. The maximum print density can be calculated by counting drops of ink in each of several overlapping grids.

Thus, the present invention utilizes information about the print density to control the heater output level rather than controlling the print speed of the inkjet printer, or using multi-pass print modes which reduce printer throughput. Similarly, this invention can be applied to print devices that control air flow or fan speed or any other device that provides direct drying of printed media based on the analysis of the ink density of the printing being performed. The present invention provides cost effective rapid drying mechanism for a printer.

DETAILED DESCRIPTION OF THE PREFERRED EMBODIMENT

Figure 1:
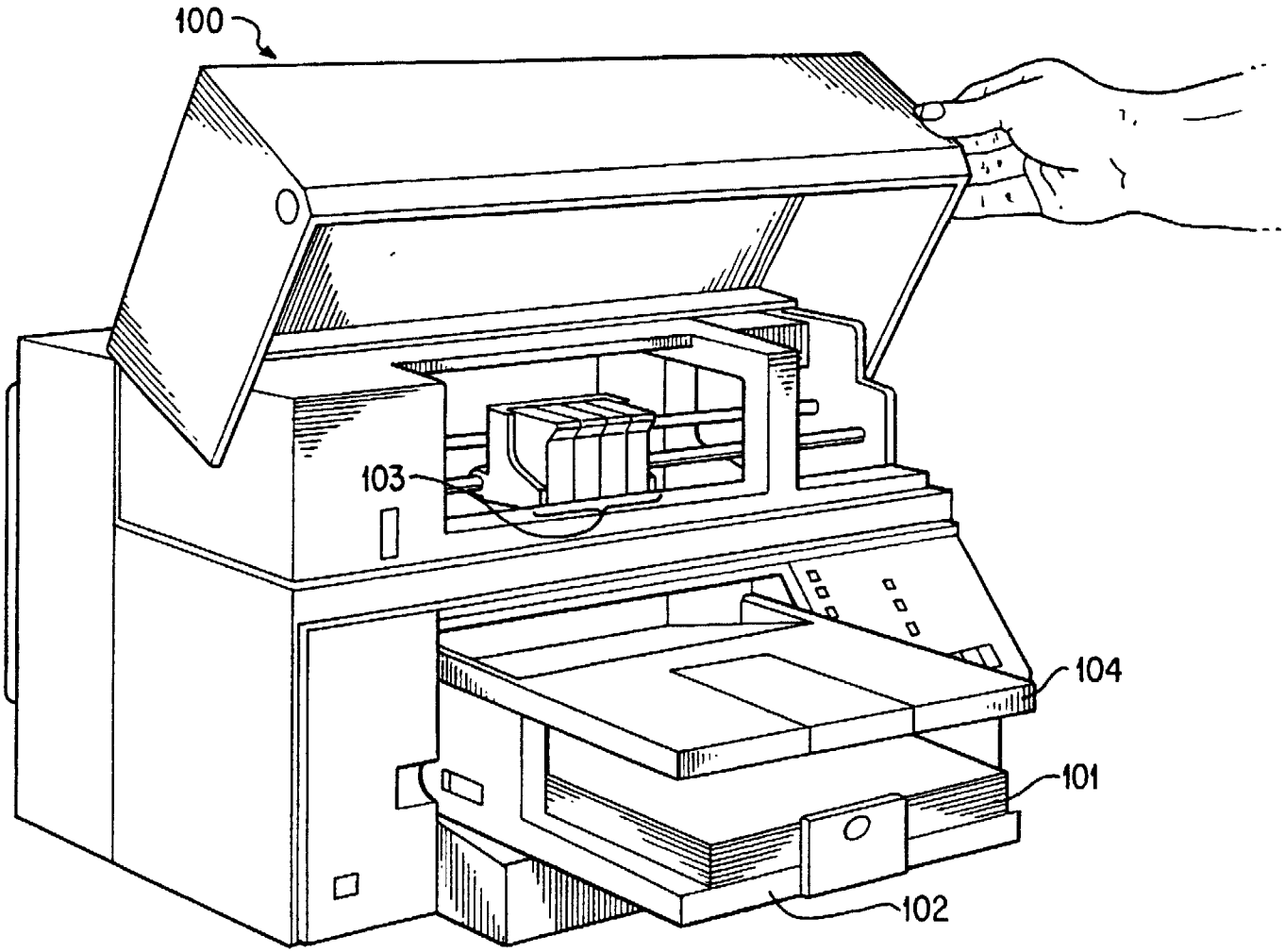
FIG. 1 is diagram of an inkjet printer embodying the present invention and having a plurality of inkjet nozzles, an input tray and an output tray.

FIG. 1 is a diagram of an inkjet printer 100 wherein the present invention is embodied. The printer 100 performs printing on sheets of paper 101 or other print media which are supplied from an input tray 102. The print media are printed by a plurality of inkjet nozzles 103 in the printer 100. After a print medium is printed, it is output and stacked onto an output tray 104.

Figure 2:
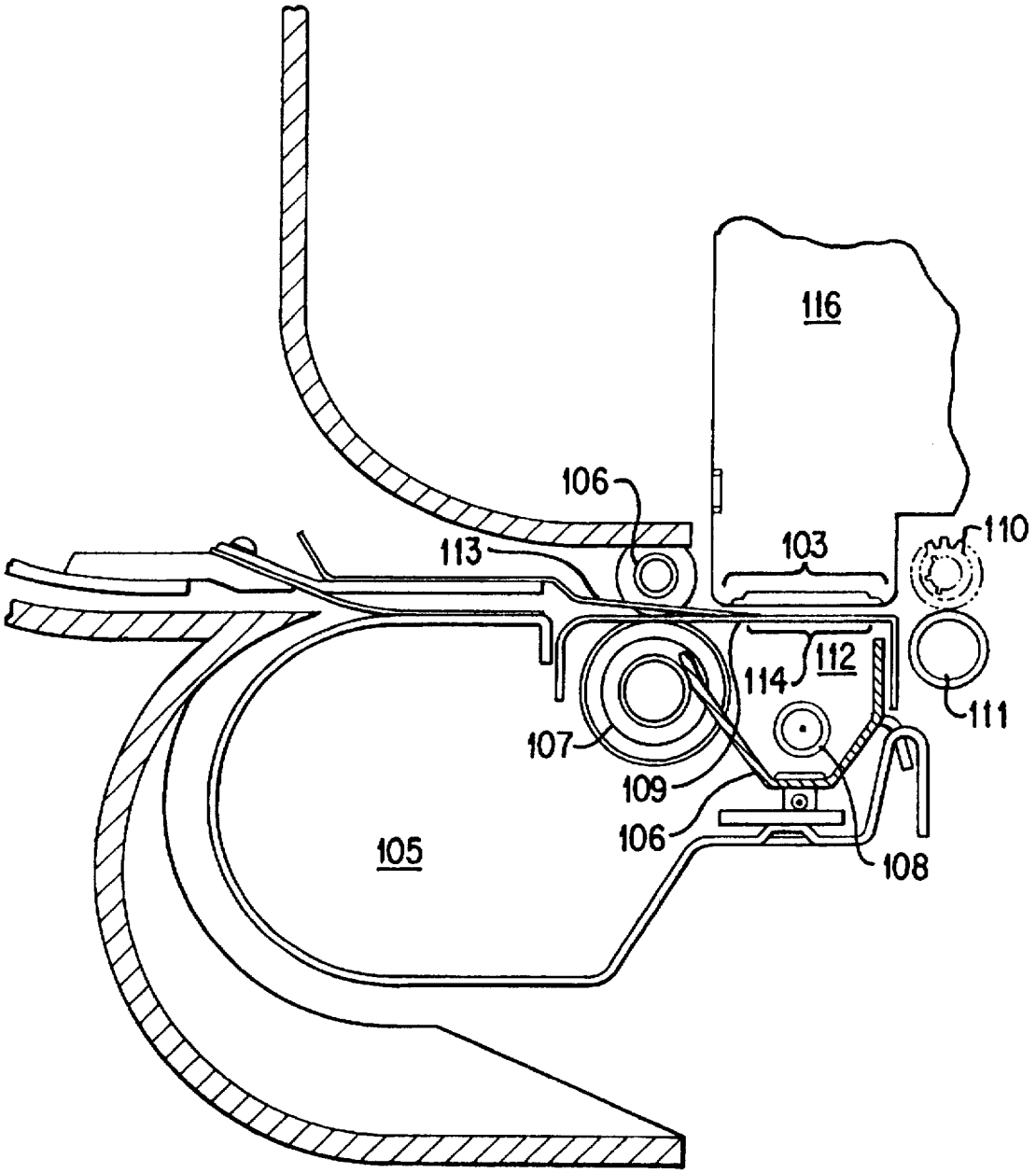
FIG. 2 is a cross-sectional view taken along a portion of the media path within the inkjet printer of FIG. 1.

FIG. 2 is a side view which shows the path along which a sheet of paper travels within the printer 100. When a sheet of paper is picked from tray 102, it is pushed by a feeder mechanism (not shown) into a paper path at the lower part of a forward paper guide 105. Before the paper passes inside the paper path defined by guide 105, it is preheated by heat generated from a preheater (not shown).

The paper path directs the paper to an interface between a pinch wheel 106 and a main drive roller 107 which is rotated by a motor (not shown). The leading edge of the paper is fed into the gap between drive roller 107 and idler roller, or pinch wheel, 106. With the paper being held against the heater screen 109 by a paper shim 113, the paper is in turn driven past the print area 114, where radiant heat is directed on the undersurface of the paper by reflector 106 and heater element 108 disposed in the heater cavity 112 defined by the reflector. The screen 109 is fitted over the cavity 112, and supports the paper as it is passed through the print zone 114, while at the same time permitting radiant and convective heat transfer from the cavity 112 to the paper. The convective heat transfer is due to free convection resulting from hot air rising through the screen and cooler air dropping, and not to any fan forcing air through the heater cavity. Once the paper covers the screen 109 during printing operations, the convection air movement is within the cavity 112.

At the print area 114, inkjet printing onto the upper surface of the paper occurs by stopping the drive rollers, driving the nozzles 103 along a swath, and operating the inkjet nozzles 103 to print a desired swath along the paper surface. After printing on a particular swath area of the paper is completed, the drive rollers 107 and 111 are actuated, and the paper is driven forward by a swath length, and swath printing commences again. After the paper passes through the print area 114 it encounters output roller 111, which is driven at the same rate as the drive roller 107, and propels the paper into the output tray.

The heater element 108 comprises a transparent quartz tube open to the air at each end thereof, and a heater wire element driven by a low voltage supply. The wire element generates radiant heat energy when electrical current is conducted by the wire, causing it to become heated, e.g., in the same fashion as an electric toaster generates heat. One type of wire material suitable for the purpose is marketed under the registered trademark "Kanthal."

The wire heater element 108 is powered from a 35 vDC signal from supply 117 (FIG. 8), which is modulated by a 31 KHz pulse width modulator to provide a square wave of variable pulse width, thereby allowing the various power settings necessary for operation of the heater 108. A thermistor 108A (FIG. 8) is used to sense the heater temperature. A constant power closed loop control circuit 204 comprising the pulse width modulator control functions, variable frequency control functions, and average current measurement and voltage measurement functions, controls the power applied to the heater element. A thermistor 108A sets the initial conditions for the heater warmup.

In response to an initial print command, the heater 108 in this exemplary embodiment is run at 112 W for a minimum of 26 seconds to ramp the heater up to operating temperature as quickly as possible. The heater power is then reduced to a default setting of 73 watts for plain paper printing, 63 watts for printing on transparent polyester media, or 28 watts for glossy polyester media. When controller 120 (FIG. 3 and 8) receives a plot file to print, controller 120 takes over control of the heater output as described below and sets the appropriate heater output based upon media type, print density and print mode. A swath of ink is applied to the paper lying over the heated platen and the heater accelerates the evaporation of solvent absorbed by the paper. When the printer has finished printing the desired output and no other output is requested, the heater element 108 power is reduced to 20 watts for a warm idle state.

The heater element 108 may be a single element the length of the horizontal swath of the printer 100, or multiple heater elements along the length of the swath of the printer 100 to allow for variable heating rates along the horizontal swath based upon varying ink densities being printed along the swath. In this embodiment the controller 120 would control the multiple heaters 108 in the same manner, but heater output would be based upon the ink density being printed above the individual heater element. This would be advantageous, for example, when a swath contains both low density text and a high density image within the same horizontal swath of the printer.

In a further embodiment, a shutter or shutters (not shown) is used to add additional control of the amount of heating to which the media is exposed. The shutter is opened and closed by controller 120 to control the amount of heat that reaches the print media. This shutter control can be used solely to control the amount of heating of the media, or in conjunction with control of the output of the heater element 108. Moreover, multiple shutters can be used along the horizontal swath of the printer in the same manner as the multiple heaters discussed above to control the amount of heating along the horizontal swath.

The print area screen 109 performs several functions. It supports the paper at the print area 109 and above the heater reflector 106. The screen is strong enough to prevent users from touching the heater element 108. The screen transmits radiative and convective heat energy to the print medium, while transmitting little if any conductive heat energy, which would cause print anomalies, due to nonuniform heat transfer. The screen 109 is designed such that the print medium does not catch a surface of the screen as it is driven through the print area. Further details on heater 108 are set forth in PRINT ZONE RADIANT HEATER FOR INKJET PRINTER, by Moore, et al., Ser. No. 08/056,287 filed Apr. 30, 1993; and THERMAL INKJET PRINTER WITH PRINT HEATER HAVING VARIABLE HEAT ENERGY FOR DIFFERENT MEDIA, by Richtmeier, et al., Ser. No. 08/137,388, filed Oct. 14, 1993 which are herein incorporated by reference.

The print cartridge 116 containing inkjet nozzles 103 are carried by a carriage which is driven along the support shaft by a mechanism which comprises, for example, a motor and a belt. Each trip along the support shaft is conventionally called a sweep. The inkjet nozzles 103, when activated, apply droplets of ink onto the paper. Typically, the inkjet nozzles are mounted on the carriage in a direction perpendicular to the direction of the sweep, so that columns of dots are printed in one sweep. The columns of dots made by inkjet nozzles across a horizontal portion of the paper is sometimes called a swath. A swath may be printed by one or more passes of the inkjet nozzles across the same horizontal portion, depending upon the required print mode. In order to reduce undesirable "banding", some of the known printing modes advance the print medium relative to the carriage in the vertical direction by only a fraction of the height of a single swath; in order to reduce "bleeding", multipass printing modes may be used in which the dots applied in successive passes are interleaved vertically and horizontally. Moreover, both single pass and multiple pass print modes may employ "Resolution Enhancement Technology" in which additional dots of ink are selectively applied between adjacent pixels to increase image density and/or to provide a smoother boundaries for curved or diagonal images.

When a swath is completely printed, the paper is advanced and ejected into the output tray 104, with the assistance of starwheel 112 and an output roller 111 which cooperate to produce a pulling force on the paper. A starwheel is used so that its pointed edges can pull the paper at the printed surface without smearing.

Figure 3:
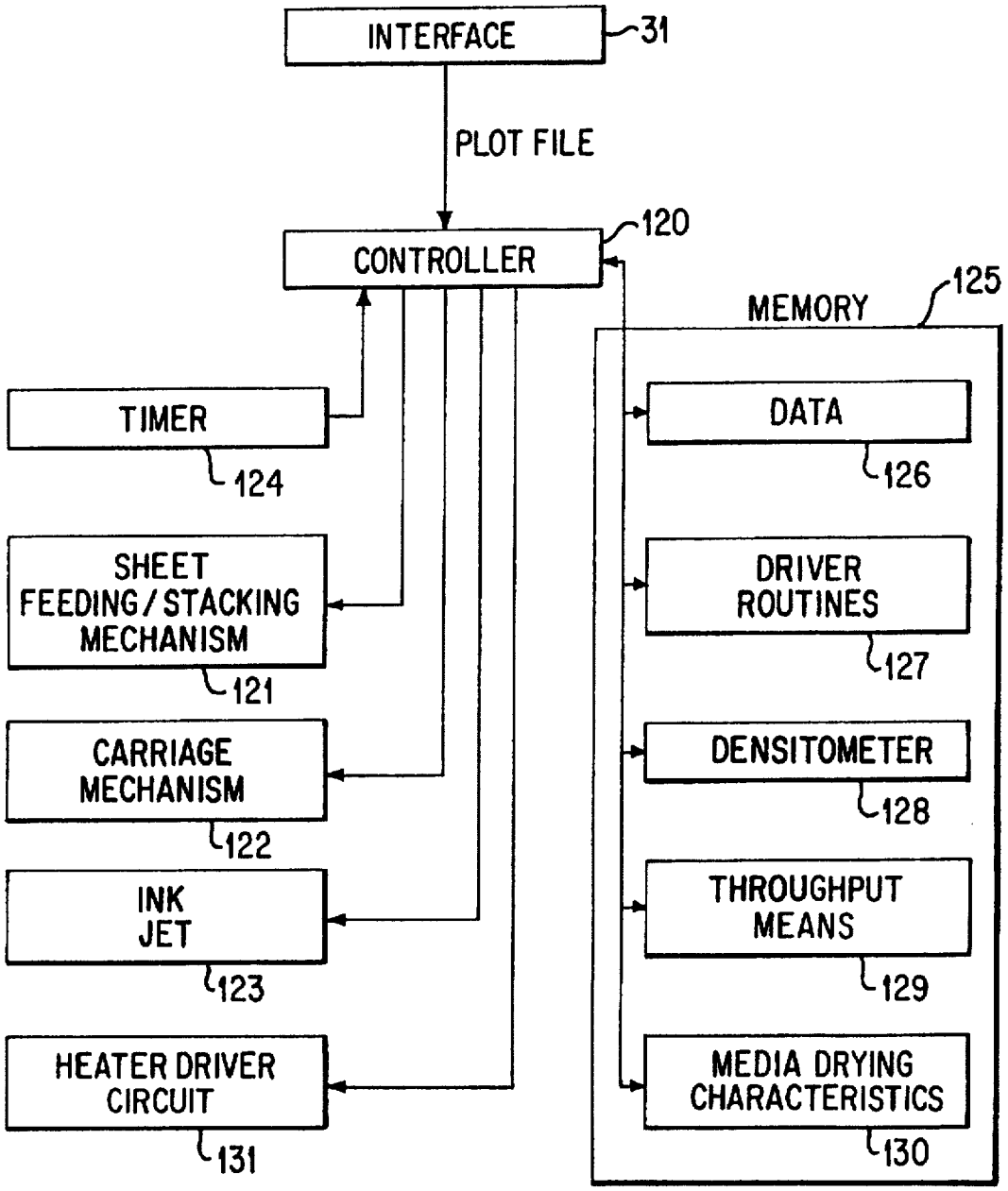
FIG. 3 is a block diagram of the main hardware components of an inkjet printer and the related software.

FIG. 3 is a logic diagram showing the main hardware components of the printer 100 and the related software. The hardware components include a controller 120 which operates to control the main operations of the printer 100. For example, the controller controls the sheet feeding/stacking mechanism 121, including the pinch wheel 106, the main drive roller 107, the starwheel 110 and the output roller 111, to feed and position a sheet of paper during a printing process. The controller 120 also controls the carriage drive mechanism 122 to move the carriage across the paper. The controller 120 also controls the inkjet nozzles 123 to activate them at appropriate times so that ink can be applied at the proper pixels of the paper. The controller 120 also controls the heater driver circuit 131 to adjust the heater to the proper output based upon media type, print density of the swath and print mode being used. The controller 120 could also control a shutter driver circuit (not shown) to adjust the heating of the media based upon media type, print density of the swath and print mode being used.

The controller 120 performs the control functions by executing instructions and data accessed from a memory 125. For example, data to be printed are received by the printer 120 under the control of a software driver. The data received are stored in a "plot file" within a data area 126 in the memory 125.

One or more timers 124 are available to controller 120. A timer may be simply be a starting clock value stored at a predetermined location in the memory. To obtain an elapsed time value, the stored starting value is then subtracted from an instantaneous clock value from a real time clock (not shown).

The instructions can be classified logically into different procedures. These procedures include different driver routines 127 such as a routine for controlling the motor which drives the main drive roller, a routine for controlling the motor which drives the output roller/star wheel, a routine for controlling the motor which drives the carriage, a routine for controlling the heater output, and a routine for controlling activation of the inkjet nozzles.

The memory 125 also stores a throughput procedure 129. The throughput procedure operates to control the throughput of the printer 100. Throughput may be thought of as the sum of a first duration T1 and a second duration T2, where T1 is the time duration between the time immediately before a first swath is printed on a sheet of paper and the time immediately after the last swath is printed, and T2 is the time duration between the final position of one sheet and the initial position of the next sheet. T2 represents the sheet feeding delay of the printer, which is typically constrained only by the drive mechanism and is therefore a constant; however T1 is also constrained by various factors related to the complexity and density of the image and the desired print quality, which in turn determine how much time is required for each of the sequential process steps of the selected print mode. Throughput procedure 129 uses horizontal and vertical logic seeking to identify blank lines between adjacent swaths (vertical logic seeking) and blank portions at either end of (or possibly within) a swath, altogether avoiding any unnecessary carriage movements and slewing the carriage at maximum slew rate over any unprinted areas over which the carriage must be slewed.

The memory 125 also stores a densitometer procedure 128 which determines a maximum density of dots of ink to be printed in the current swath. The memory 125 also stores media drying characteristics 130 for various types of media which is used by controller 120 in conjunction with the results from the densitometer procedure 128 to ensure that the correct heater output for the print density, print mode and media is used.

Figure 8:
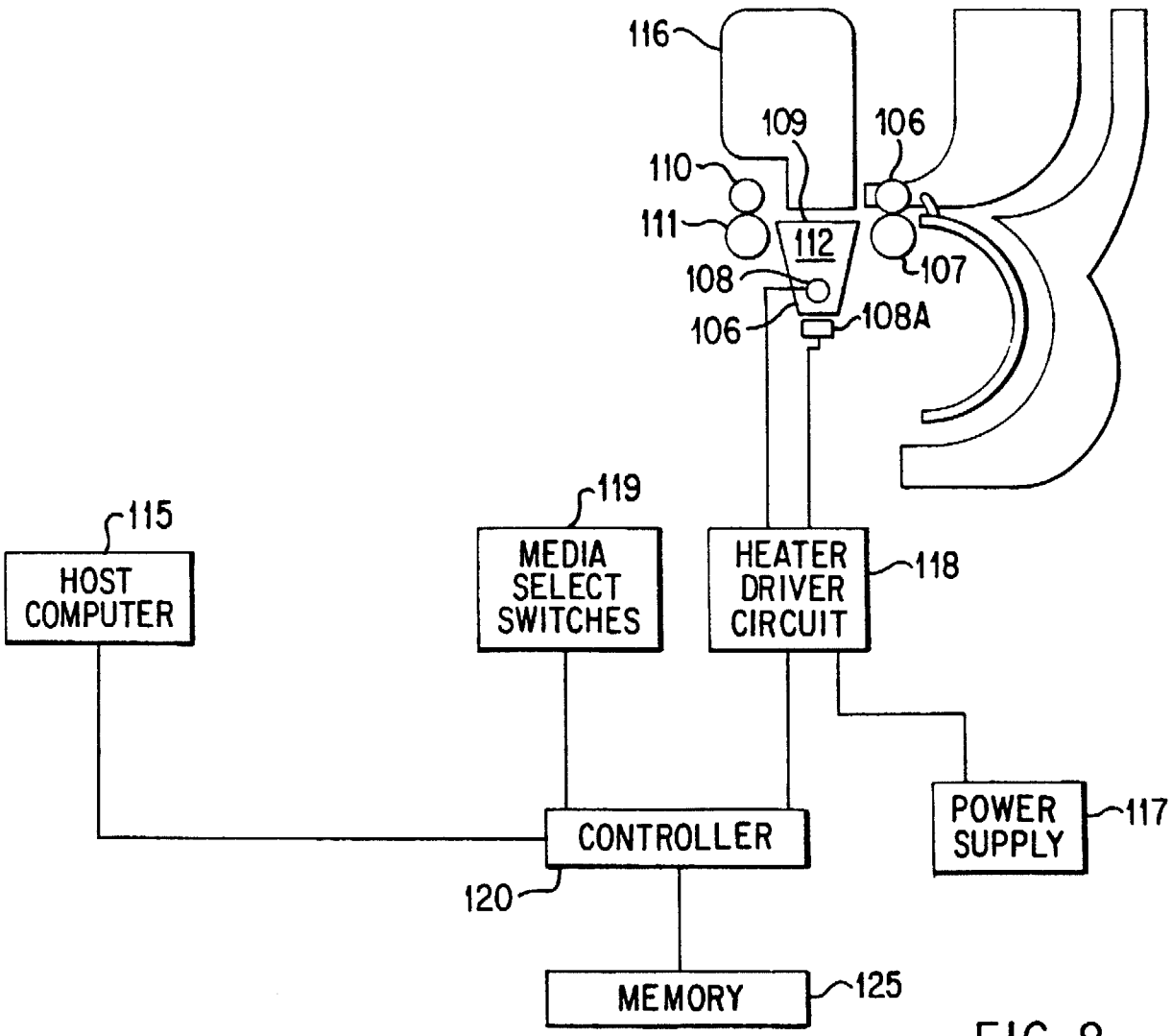
FIG. 8 is a schematic block diagram illustrating the control elements associated with the heater element.

FIG. 8 is a schematic block diagram illustrating the control elements associated with the heater element 108. An exemplary inkjet cartridge 116 is disposed above the print area. The heater element 108 with the reflector 106 is disposed below the print area. A temperature sensing resistor 108A is disposed on a circuit board disposed in the bottom portion of the reflector 106, and senses the temperature within the reflector cavity 112.

The electronic components are shown in schematic form in FIG. 8 as well. A printer controller 120 interfaces with a host computer 115, such as a personal computer or workstation, which provides print instructions and print data. The printer 100 further includes media select switches and other operator control switches 119, which provide a means for the operator to indicate the particular type of medium to be loaded into the printer, e.g., plain paper, special coated paper, special glossy paper, or transparencies. Alternatively, the host computer signals may specify the particular type of media for which the printer is to be set up. As described above, the heater element 108 is controlled by a constant power feedback circuit, wherein heater current sensing and voltage sensing is employed to set the heater element drive signals produced by the drive circuit 118 from DC power supplied by the printer power supply 117. The heater drive circuit 118 is in turn controlled by the controller 120. The controller 120 accesses data stored in the memory devices 125 which may, for example, store data on drying characteristics for different media 130, densitometer print density data 128, and any other parameters of the printer, ink or media.

Typically, a sheet of paper is printed by applying ink at the specified dot positions (pixels). The dots may be printed in single (e.g., black) or multiple colors. To print a multiple color image, the carriage may have to make more than one sweep across the print medium and make two or more drops of ink with different primary colors at the same dot locations ("pixels"), as disclosed in U.S. Pat. No. 4,855,752 which is assigned to the assignee of the present invention.

The printer 100 has several different modes of printing. Each of the different modes is used to produce a different type or quality of an image. For example, one or more "high quality" modes can be specified whereby density of the print dots is increased to enhance the quality of the printed images. In some printers, a "high quality" mode of printing may require the printer 100 to make multiple passes or sweeps across substantially the same horizontal portion of the page. The present invention may obviate the need for special print modes based on media types. By utilizing the ink absorbtion curves for various media, the output profile of the heater can be adjusted to provide correct ink penetration and dry time rates while still maximizing throughout.

For example, in its high quality three-pass mode, printer 100 make three sweeps across the page to print a single swath. In each of the three sweeps, the printer would print one of every three consecutive dots so as to allow more time for one dot to dry before the neighboring dot is printed, and thereby preventing the possibility that the ink of the two neighboring dots would combine to produce an unwanted shape or color. Such a three-pass printing mode may also be used to reduce banding by dividing the swath into three reduced-height bands, printed in successive but overlapping printing cycles each providing for three passes across an associated reduced-height band.

Figure 9:
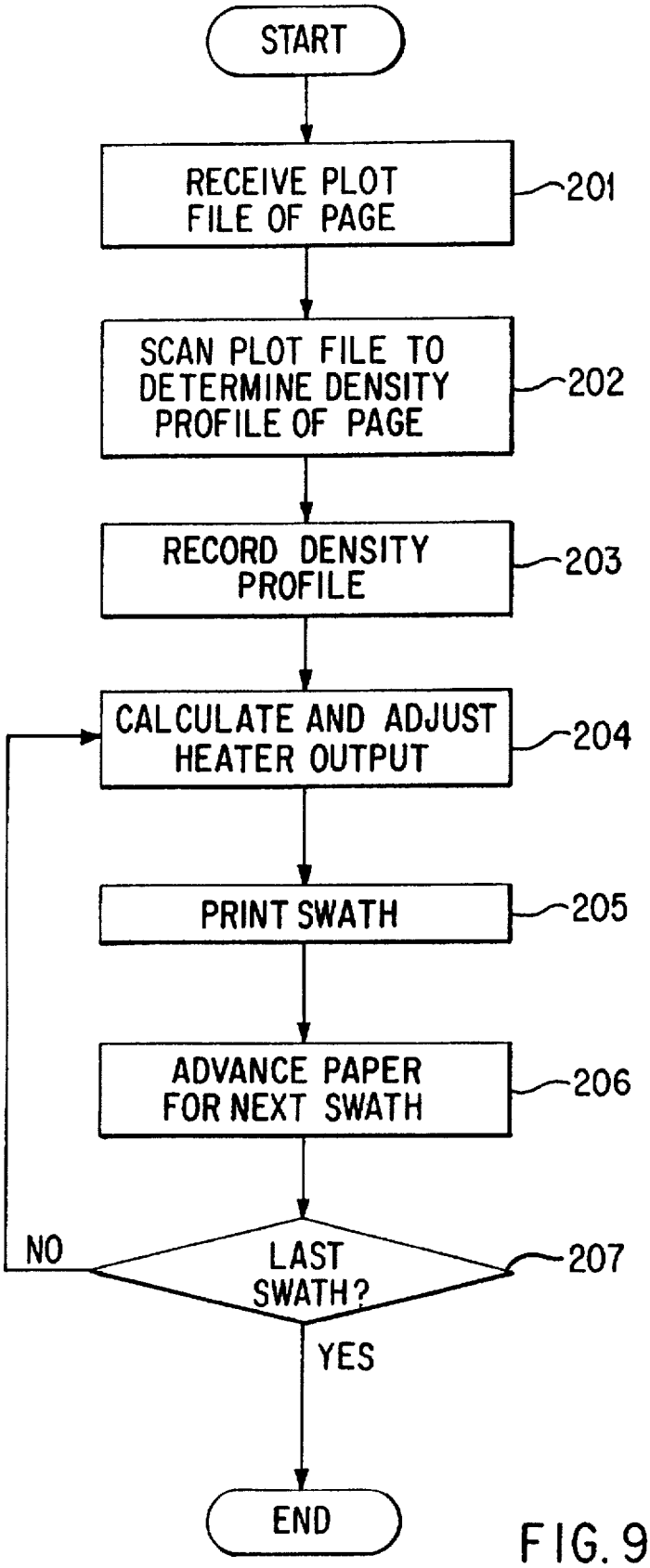
FIG. 9 is a flow chart showing the general steps performed by the printer in printing an image.

FIG. 9 is a flow chart showing the general steps performed by the printer in printing an image. In known manner, the image to be printed is defined by the "plot file" which specified which pixels are and which pixels are not to be coated with dots of ink. For color images, the color of the ink is also specified in the plot file. To print a page, a plot file is first sent to the printer 100 (step 201). As the plot file is being received by the printer 100, it is scanned by the controller 120. The controller 120 scans the plot file to divide it into one or more printed swaths and at the same time produces a density profile for the entire page (step 202).

More particularly, when the controller 120 scans the plot file, it also divides it into a plurality of grids each with a predetermined shape and size, each identified by an x-coordinate and a y-coordinate. For each grid, the controller 120 determines the number of dots that need to be printed with each type of ink.

According to one method, each swath to be printed in a single sweep of the carriage is subdivided into a plurality of rows and each row is subdivided into a plurality of non-overlapping grids; each dot on the page may belong to only one grid. The density of each grid is then determined by counting the number of pixels to be printed in a representative randomly selected sample of the pixels in the grid. A maximum row density is then obtained from the individual grid densities in each row, and a maximum sweep density is then obtained from the individual row densities in the sweep.

Figure 4:
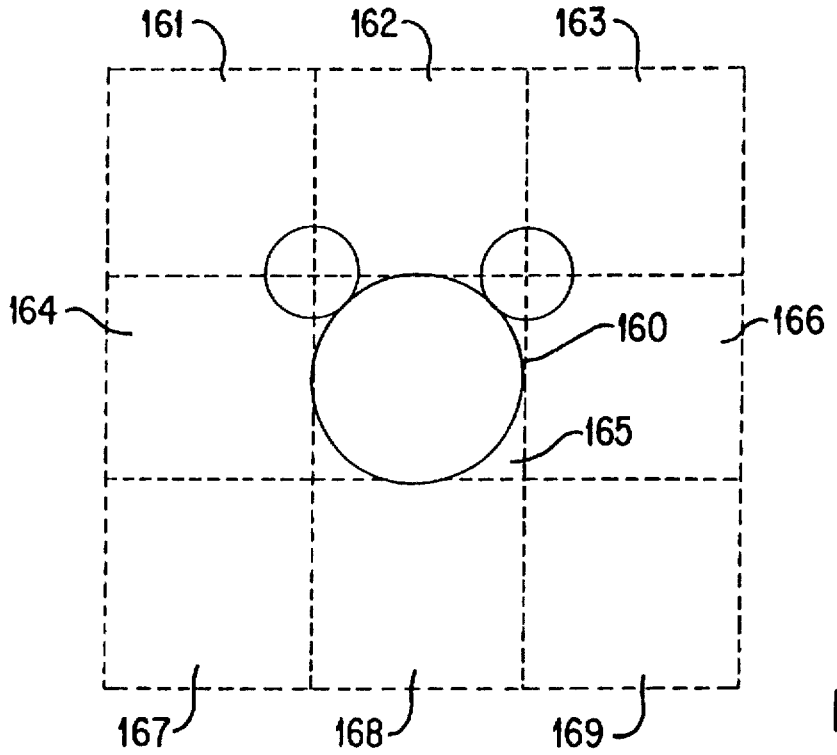
FIG. 4 shows how an image may be scanned by a non-overlap method.
Figure 5:
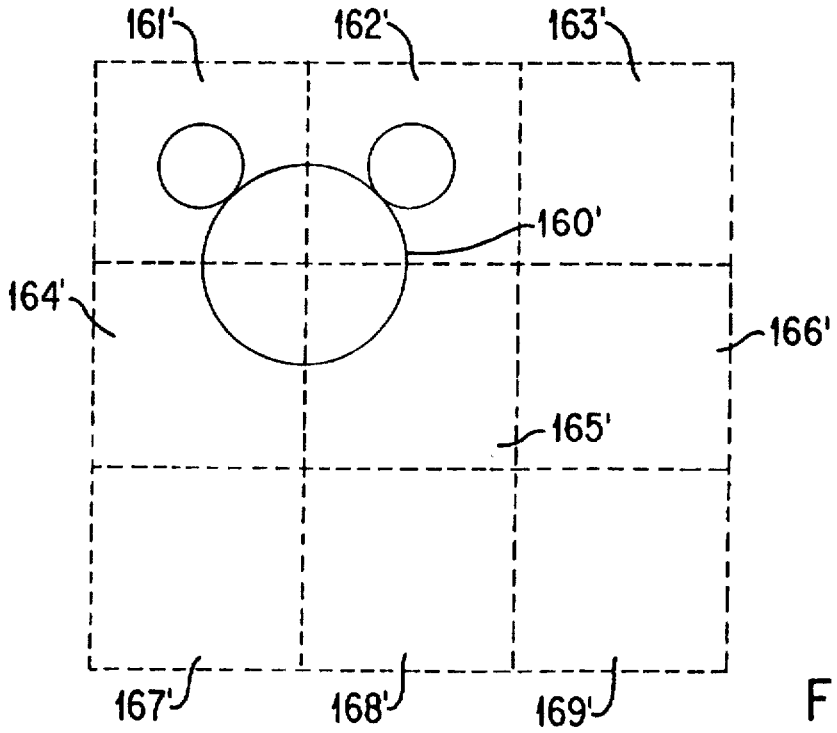
FIG. 5 shows how a difference may result in the method of FIG. 4 if the same image is scanned by the same non-overlap method when the position of the image changes.

Although such non-overlap scanning using only a representative sample is faster, it may, however, produce inaccurate results. To illustrate, assume an image to be printed by the printer has the shape 160 as shown in FIG. 4 and assume that the scanning is performed by square grids 161, 162, . . . 169. Depending upon the position of the image 160 with respect to the grids, different density profiles may result. For example, if the image 160 falls by chance in the middle of a grid 165 as shown in FIG. 4 the density profile would show a high density, D1, in grid 165. On the other hand, if same image 160' per chance falls in the intersection of grids 161', 162', 164' and 165' as shown in FIG. 5, then the highest density of the image 160' would be about a fourth of the density D1 obtain from the scanning performed as shown in FIG. 4.

Moreover, accuracy of the local density profile is also a function of the size of the grid. For example, a density profile which is made with a non-overlapping grid size of 150×150 dots will more accurately reflect a dense image having a size of only 300×300 dots than a density profile which is made with a non-overlapping grid size of 300×300 dots. However, if grid size were so small that a single grid could have a density of 100% but the solvent could nevertheless rapidly diffuse into adjacent unprinted areas, such a small grid size would not provide a useful measure of the probability of an image being sufficiently dense to adversely affect print quality.

Figure 6:
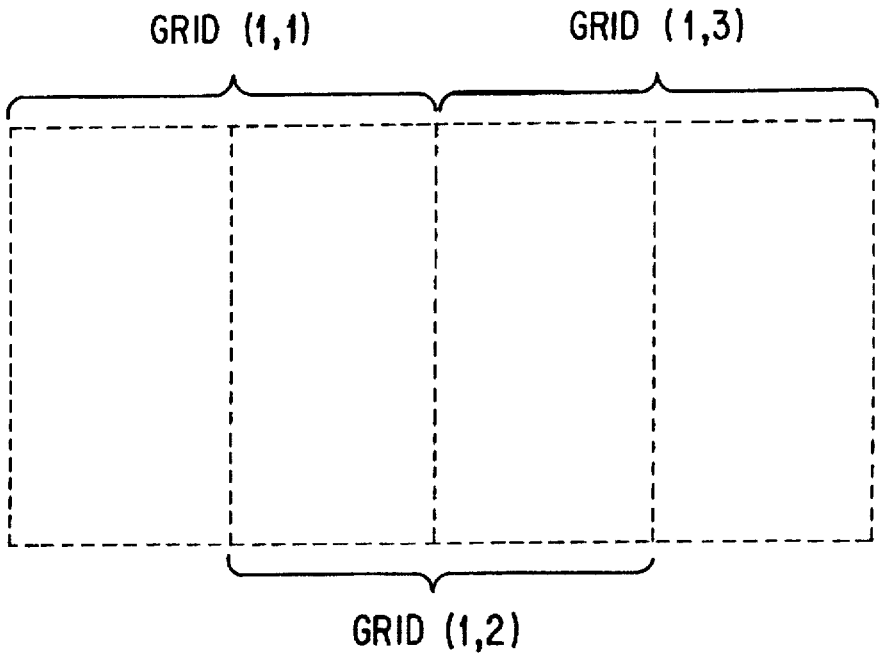
FIG. 6 shows how scanning can be overlapped horizontally to reduce differences caused by positional variations of an image.

However, more accurate measurement of the dot density may be obtained by overlapping the larger grids vertically and/or horizontally, to thereby obtain the advantages of both the larger and the smaller grid sizes. FIG. 6 shows how horizontal overlapping is performed with respect to three exemplary grids G(1,1), G(1,2) and G(1,3). As shown, the left half of grid G(1,2) overlaps right half of grid G(1,1). On the other hand, the right half of grid G(1,2) is overlapped by the left half of grid G(1,3).

Figure 7:
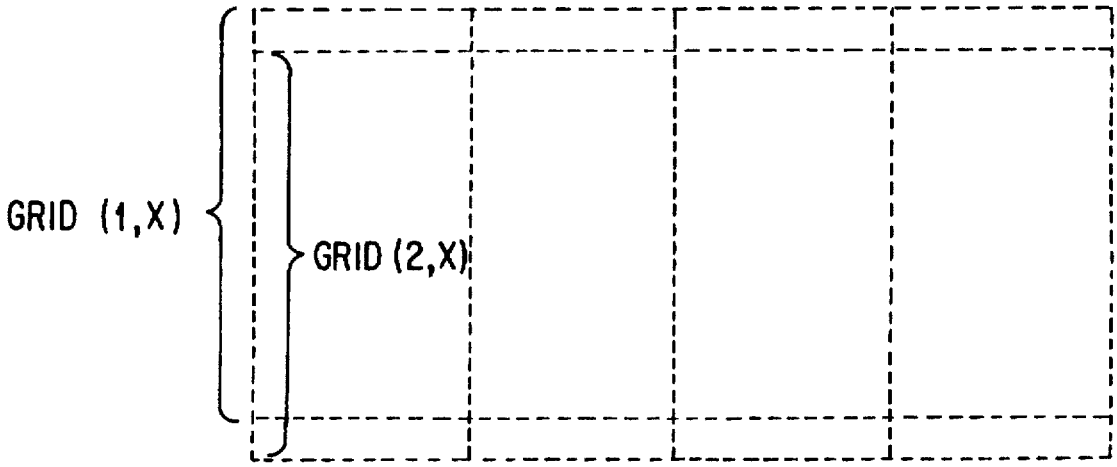
FIG. 7 shows how scanning can be overlapped vertically to reduce differences caused by positional variations of an image.

FIG. 7 shows how both vertical and horizontal overlapping may be combined. A first row of grids G(1,x), comprising grids G(1,1), G(1,2) and G(1,3) of FIG. 6 and a second row G(2,x) of grids which overlap with the first row G(1,x). For example, the upper ⅝ of grid G(2,1) in the second row overlaps the lower ⅝ of grid G(1,1) of the first row, and the upper ⅝ of grid G(2,2) overlaps the lower ⅝ of grid G(1,2).

Figure 10:
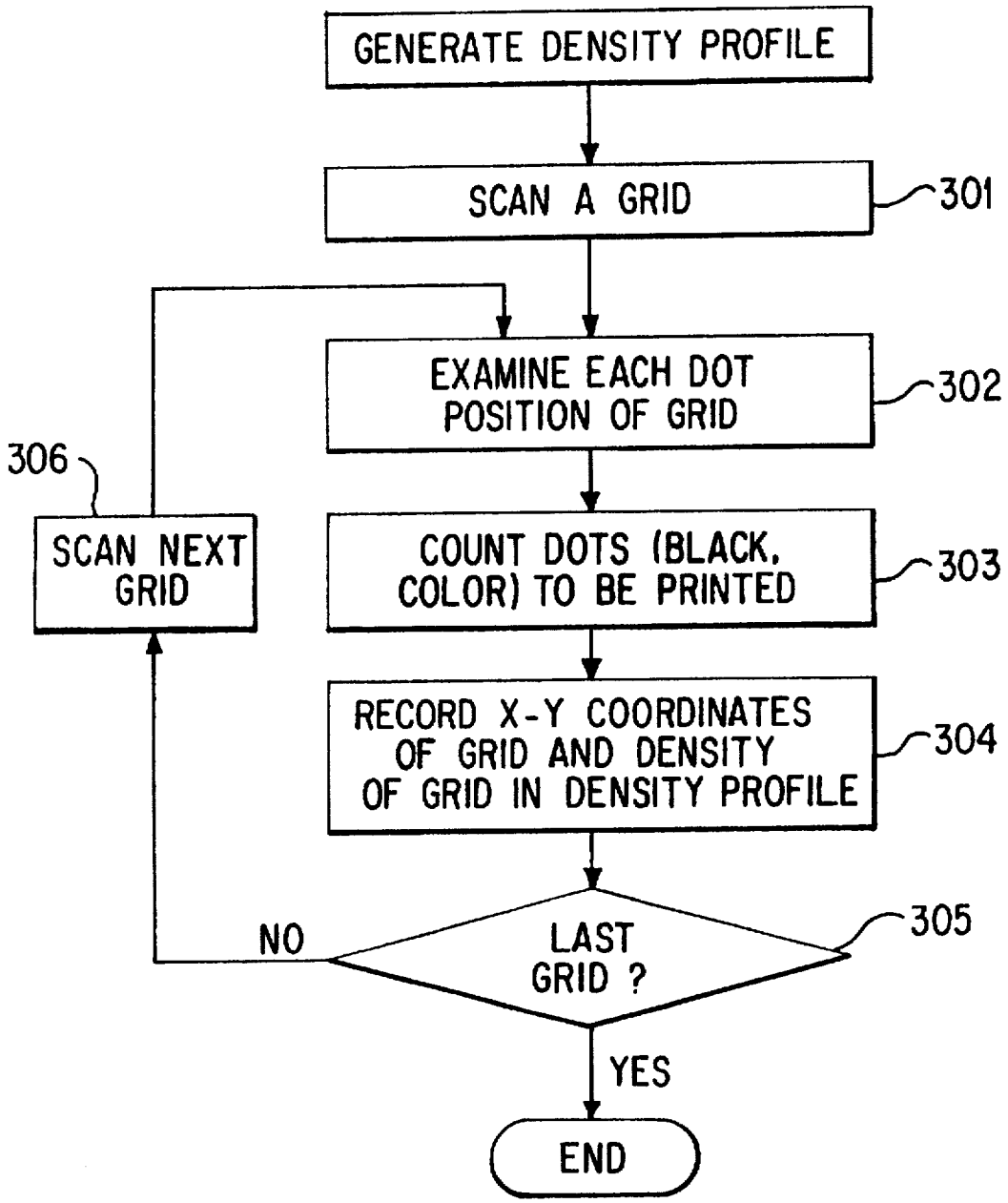
FIG. 10 is a flow chart showing the steps performed by the printer for generating a density profile of an image to be printed.

FIG. 10 is a flow chart illustrating the basic steps required to generate a density profile. The steps are performed by the densitometer procedure when it is executed by the controller 120.

In step 301, a grid of the image to be printed is scanned. In scanning the grid, each dot position of the grid is examined (step 302). Within the grid, the number of dot positions which will be printed with black dot and the number of dot positions which will be printed with colored dots are counted (step 303). Separate counts are made of black and colored dots because they are typically produced by inks having different formulations and concentrations. Because all the grids have the same size, the count can therefore be used directly to represent the density of the grip. After all the dot positions are examined, the count and the coordinates of the grid are stored into the memory 125 (step 304). The controller 120 then examines the plot file to determine whether the current grid is the last grid of the page (step 305). If the current grid is not the last grid, then the process is repeated on the next grid (step 306). Otherwise, the procedure terminates.

Figure 11:
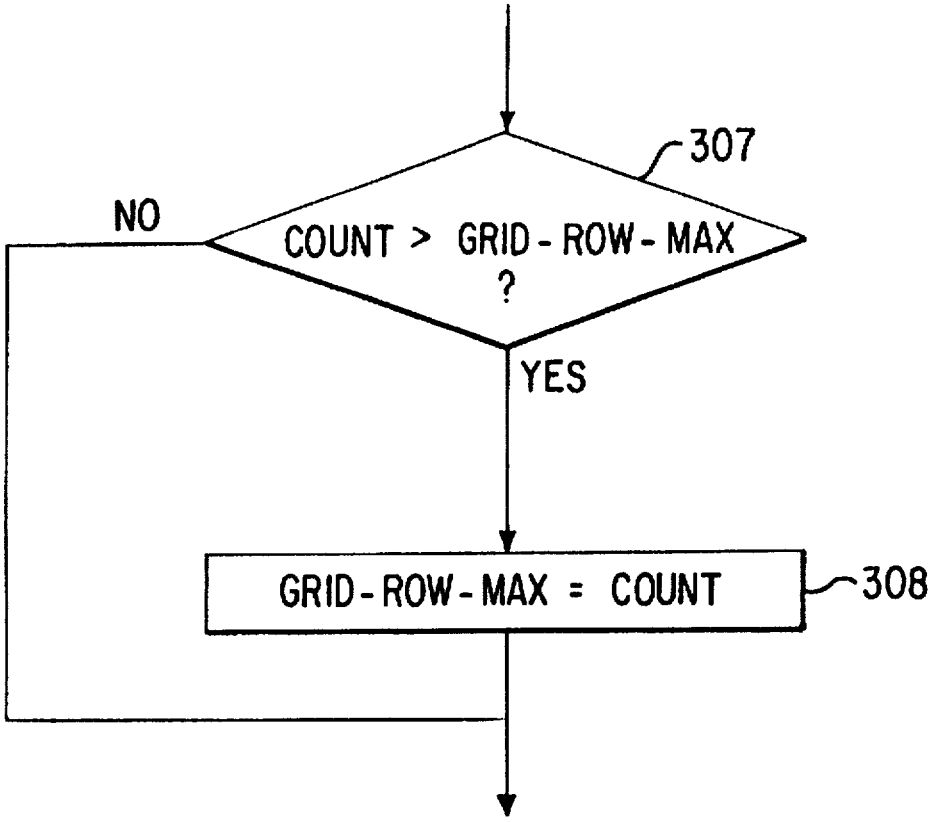
FIG. 11 is a flow chart showing the additional steps performed by the printer to find a grid with the maximum density in each row of grids.

In practice, rather than maintaining a density history for each grid, only a maximum density for one or more rows of grids can be stored, with the size of the individual grids preferably being preferably decreased. As a row of grids is being scanned, the grid with the maximum density in the row is located, along with its density value. This is accomplished by providing a variable, GRID-ROW-MAX, and the additional steps shown in FIG. 11 which are performed between steps 303 and 305. In step 307, the count obtained from step 303 is compared with the value stored in GRID-ROW-MAX. If the count of the current grid is greater than GRID-ROW-MAX, its value is stored into GRID-ROW-MAX (step 308); otherwise, step 308 is bypassed. It will be understood that GRID-ROW-MAX is initialized (by setting it to "0") at the beginning of the procedure shown in FIG. 9. If it is necessary to determine a maximum density for an area covering more than one grid row, this can be done by using a similar procedure to determine the maximum of the previously stored GRID-ROW-MAX values for each grid row involved. Alternatively, GRID-ROW-MAX is not re-initialized at the beginning of each row, but is re-initialized only once at the beginning of the area and is used until all the rows in that area have been processed. Similarly, if it is desired to determine a local density based on a grid size larger than that used to process the individual rows, this may be approximated by assuming that the maximum density locations in adjacent rows relate to adjacent portions of the image, and thus may be approximated by averaging the maximum densities of the adjoining rows; in any event, such an assumption would provide a calculated maximum density that is no less than the actual density.

Optimization of the printing characteristics of a given printer such as drop volume, resolution and print speed are used match the total ink flux with the required heating rates. This is necessary to balance the output and response time of the heater with the total ink flux within the grid. In practice, the grid size must be large enough to balance the ink flux with the thermal capacity of the heater system. Larger grid sizes may be necessary depending on the thermal response time of the heater. Ideally, an "instantaneous" heater response time allows optimization of drying with very small grids.

Referring back to FIG. 9, after the plot file is scanned and the required density information has been stored as a function of grid or row location (step 203), the appropriate heater output can be calculated and adjusted (step 204) based upon the print density information from the densitometer 128, the media select switches 119 or media information from the host computer 115, the type of print mode being used (i.e., single or multi-pass), and the media drying characteristics 130 stored in memory 125. The swath is then printed (step 205) by the controller 120 executing the appropriate driver routines to position the inkjet nozzles in a known position relative to a top corner of the page. When initialization is complete, the controller 120 causes the swath to be printed (step 205) and the paper is advanced for the printing of the next swath (step 206). The controller 120 then checks to see if the current swath is the last swath of the page (step 207), if the answer is yes the paper is ejected to the output tray 104, if not the controller returns to step 204 to perform the printing of the next swath.

The controller 120 scans the density profile for all the grids (or the density profiles for all the rows, if only GRID-ROW-MAX was stored), whose y-coordinates are within the values of upper and lower boundaries of the swath and retrieves the maximum density associated with those grids (or rows), and stores its density in the memory 125. To facilitate the concurrent scanning of the plot file and the printing of the individual swaths, a respective location can be reserved in the memory 125 for storing the value of the maximum density of each swath.

The calculation of the appropriate heater output (FIG. 9 step 204) can be determined by several methods. One such preferred method is to perform a table look-up based upon the maximum print density of the swath and media drying characteristics to find the appropriate heater for the media type and print density before the swath is printed. In order to speed up and simplify the required computations, separate tables are preferably maintained for different media types and print modes. The table look-up can be performed using either the average or the maximum density of the swath as determined in the densitometer procedure. The controller 120 performs the table look-up to determine the appropriate heater output for the swath.

The values of the table can be obtained empirically. The setting points for the heater are dependent on several factors, including the type of heater, spectral output of the heater, and thermal absorbtion characteristics of the media and inks. Several sets of exemplary values are listed in the following tables:

| Density | Heater Output (watts) |
|---|---|
| Plain Paper | |
| >150 | 112 |
| >75 | 95 |
| >25 | 73 |
| >0 | 40 |
| Color Polyester Transparency | |
| >150 | 90 |
| >75 | 81 |
| >25 | 64 |
| >0 | 30 |
| Glossy Polyester Paper | |
| >150 | 58 |
| >75 | 43 |
| >25 | 28 |
| >0 | 10 |

Other methods for determining the heater output with greater accuracy, but which are computationally more complex may also be used. After calculating the heater output, controller 120 controls heater 108 through heater driver circuit 131.

In accordance with the present invention, printer throughout can be improved by a factor of two or three based upon the print media.

It is understood that the above-described embodiment is merely provided to illustrate the principles of the present invention, and that other embodiments may readily be devised using these principles by those skilled in the art without departing from the scope and spirit of the invention.

What is claimed is:

1. An inkjet printer for printing an image on a sheet of print media, comprising:

a carriage mounted inkjet printing mechanism for applying liquid ink to said sheet as successive columns of dots contained within a first horizontal swath of a plot file divided into a plurality of grids to thereby form a portion of said image, a drive mechanism to move said sheet relative to said carriage to thereby position said print head at a beginning of a second horizontal swath, of said plot file selection means for specifying a selected print mode and a selected print medium, a heater driver circuit for controlling a variable output of a heater in said printer, densitometer means, responsive to the receipt of the plot file, to be printed, for counting the dots in a plurality of overlapping grid portions of said plot file to thereby locate a grid portion having a respective maximum density value, calculating means responsive to the receipt of each said maximum density value from said densitometer means for determining a respective optimal heater output value based upon the said maximum density value, upon said selected print mode, and upon said selected print medium, and a controller operatively coupled to said heater driver circuit, said controller comprising:

a preheating means responsive to the receipt of an initial print command, for ramping the heater up to an operating temperature dependent only on the selected medium, a drying means responsive to an output from said calculating means, for controlling an amount of heating to which the sheet is exposed to said optimal heater output value, and an idle mode responsive to the completion of printing of said sheet, for maintaining the heater in a warm idle state independent of both the selected medium and the selected print mode.

2. A printer as in claim 1, wherein said overlapping grid portions are defined by horizontally overlapping grids over the first horizontal swath.

3. A printer as in claim 1, wherein said overlapping grid portions are defined by vertically overlapping grids over the first horizontal swath.

4. A printer as in claim 1, wherein said calculating means uses said maximum density to perform a table look-up.

5. A printer as in claim 1, wherein said calculating means calculates said heater output as a linear function of at least two separately measured maximum density values.

* * * * *

UNITED STATES PATENT AND TRADEMARK OFFICE

CERTIFICATE OF CORRECTION

PATENT NO. : 5,784,090
DATED : July 21, 1998
INVENTOR(S) : Selensky, et. al.

It is certified that error appears in the above-identified patent and that said Letters Patent is hereby corrected as shown below:

Column 14, line 36, delete "mode" and insert --means,--.

Signed and Sealed this

Twenty-fourth Day of August, 1999

*Attest:*

Q. TODD DICKINSON

*Attesting Officer*

*Acting Commissioner of Patents and Trademarks*